US009070356B2

(12) United States Patent
Ashley et al.

(10) Patent No.: US 9,070,356 B2
(45) **Date of Patent: *Jun. 30, 2015**

(54) METHOD AND APPARATUS FOR GENERATING A CANDIDATE CODE-VECTOR TO CODE AN INFORMATIONAL SIGNAL

(75) Inventors: James P. Ashley, Naperville, IL (US); Udar Mittal, Hoffman Estates, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 525 days.

This patent is subject to a terminal disclaimer.

(21) Appl. No.: 13/439,121

(22) Filed: Apr. 4, 2012

(65) Prior Publication Data

US 2013/0268266 A1 Oct. 10, 2013

(51) Int. Cl.

| | |
|---|---|
| ***G10L 19/12*** | (2013.01) |
| ***G10L 19/00*** | (2013.01) |
| ***G10L 19/083*** | (2013.01) |
| *G10L 19/005* | (2013.01) |

(52) U.S. Cl.

CPC ..... *G10L 19/00* (2013.01); *G10L 19/005* (2013.01); *G10L 19/083* (2013.01); *G10L 19/12* (2013.01)

(58) Field of Classification Search

CPC ..... G10I 19/083; G10I 19/005; G10I 19/012; G10I 19/08; G10I 21/0205; G10I 19/12; G10I 19/107; G10I 19/09; G10I 19/20; G10I 19/18; G10I 19/0204; G10I 19/26; G10I 19/125

USPC ..... 704/223, 219, 222, 220, 264, 229, 216, 704/218, 226, 230, 225, 207

See application file for complete search history.

(56) References Cited

U.S. PATENT DOCUMENTS

| | | | | |
|---|---|---|---|---|
| 5,495,555 | A * | 2/1996 | Swaminathan | 704/207 |
| 5,664,055 | A * | 9/1997 | Kroon | 704/223 |
| 5,754,976 | A | 5/1998 | Adoul et al. | |
| 6,104,992 | A * | 8/2000 | Gao et al. | 704/220 |

(Continued)

FOREIGN PATENT DOCUMENTS

| | | |
|---|---|---|
| EP | 2648184 A1 | 10/2013 |
| WO | 9730525 A1 | 8/1997 |

OTHER PUBLICATIONS

Patent Cooperation Treaty, "PCT Search Report and Written Opinion of the International Searching Authority" for International Application No. PCT/US2013/067185, Dec. 20, 2013, 9 pages.

European Patent Office, "Extended European Search Report" for Patent Application No. 13160603.0, Jul. 25, 2013, 9 pages.

(Continued)

*Primary Examiner* — Vijay B Chawan

(74) *Attorney, Agent, or Firm* — Birch, Stewart, Kolasch & Birch, LLP

(57) ABSTRACT

A method (300) and apparatus (100) generate a candidate code-vector to code an information signal. The method can include producing (310) a target vector from a received input signal. The method can include constructing (320) a plurality of inverse weighting functions based on the target vector. The method can include evaluating (330) an error value associated with each of the plurality of inverse weighting functions to produce a fixed codebook code-vector. The method can include generating (340) a codeword representative of the fixed codebook code-vector, where the codeword can be used by a decoder to generate an approximation of the input signal.

23 Claims, 8 Drawing Sheets

(56) References Cited

U.S. PATENT DOCUMENTS

| | | | | |
|---|---|---|---|---|
| 6,236,960 | B1 | 5/2001 | Peng et al. | |
| 6,493,665 | B1 * | 12/2002 | Su et al. | 704/230 |
| 6,807,524 | B1 * | 10/2004 | Bessette et al. | 704/200.1 |
| 7,047,188 | B2 | 5/2006 | Jasiuk et al. | |
| 7,054,807 | B2 | 5/2006 | Mittal et al. | |
| 8,660,840 | B2 * | 2/2014 | Ananthapadmanabhan et al. | 704/230 |
| 2001/0023395 | A1 * | 9/2001 | Su et al. | 704/220 |
| 2003/0097258 | A1 * | 5/2003 | Thyssen | 704/222 |
| 2004/0260542 | A1 * | 12/2004 | Ananthapadmanabhan et al. | 704/219 |
| 2005/0108007 | A1 * | 5/2005 | Bessette et al. | 704/223 |
| 2008/0294429 | A1 * | 11/2008 | Su et al. | 704/222 |
| 2008/0312917 | A1 * | 12/2008 | Ananthapadmanabhan et al. | 704/230 |
| 2009/0157395 | A1 * | 6/2009 | Su et al. | 704/207 |
| 2009/0182558 | A1 * | 7/2009 | Su et al. | 704/230 |
| 2010/0280831 | A1 * | 11/2010 | Salami et al. | 704/500 |
| 2012/0290295 | A1 * | 11/2012 | Eksler | 704/219 |
| 2013/0268266 | A1 | 10/2013 | Ashley et al. | |

OTHER PUBLICATIONS

Udar Mittal et al., "Low Complexity Factorial Pulse Coding of MDCT Coefficients Using Approximation of Combinatorial Functions", Int'l Conf. on Acoustics, Speech, and Signal Processing, Apr. 15-20, 2007, pp. 289-292.

James Ooi, "Application of Wavelets to Speech Coding", Massachusetts Institute of Technology, May 1993, 128 pages.

International Telecommunication Union, "Series G: Transmission Systems and Media, Digital Systems and Networks, Digital Terminal Equipments—Coding of Voice and Audio Signals", ITU-T G.718, Jun. 2008, 257 pages.

M. Elshafei Ahmed and M. I. Al-Suwaiyel, "Fast Methods for Code Search in CELP", IEEE Transactions on Speech and Audio Processing, Jul. 1993, pp. 315-325, vol. 1 No. 3.

W. Bastiaan Kleijn, et al., "Fast Methods for the CELP Speech Coding Algorithm", IEEE Transactions on Acoustics, Speech, and Signal Processing, Aug. 1990, pp. 1330-1342, vol. 38 No. 8.

C. LaFlamme, et al., "On Reducing Computational Complexity of Codebook Search in CELP Coder through the Use of Algebraic Codes", IEEE Int'l Conf. on Acoustics, Speech, and Signal Processing, Apr. 3, 1990, pp. 177-180.

* cited by examiner

METHOD AND APPARATUS FOR GENERATING A CANDIDATE CODE-VECTOR TO CODE AN INFORMATIONAL SIGNAL

BACKGROUND

1. Field

The present disclosure relates, in general, to signal compression systems and, more particularly, to Code Excited Linear Prediction (CELP)-type speech coding systems.

2. Introduction

Compression of digital speech and audio signals is well known. Compression is generally required to efficiently transmit signals over a communications channel or to compress the signals for storage on a digital media device, such as a solid-state memory device or computer hard disk. Although many compression techniques exist, one method that has remained very popular for digital speech coding is known as Code Excited Linear Prediction (CELP), which is one of a family of "analysis-by-synthesis" coding algorithms. Analysis-by-synthesis generally refers to a coding process by which multiple parameters of a digital model are used to synthesize a set of candidate signals that are compared to an input signal and analyzed for distortion. A set of parameters that yields a lowest distortion is then either transmitted or stored, and eventually used to reconstruct an estimate of the original input signal. CELP is a particular analysis-by-synthesis method that uses one or more codebooks where each codebook essentially includes sets of code-vectors that are retrieved from the codebook in response to a codebook index.

For example, FIG. 6 is a block diagram of a CELP encoder 600 of the prior art. In CELP encoder 600, an input signal s(n), such as a speech signal, is applied to a Linear Predictive Coding (LPC) analysis block 601, where linear predictive coding is used to estimate a short-term spectral envelope. The resulting spectral parameters are denoted by the transfer function A(z). The spectral parameters are applied to an LPC Quantization block 602 that quantizes the spectral parameters to produce quantized spectral parameters $A_q$ that are suitable for use in a multiplexer 608. The quantized spectral parameters $A_q$ are then conveyed to multiplexer 608, and the multiplexer 608 produces a coded bitstream based on the quantized spectral parameters and a set of codebook-related parameters, τ, β, k, and γ, that are determined by a squared error minimization/parameter quantization block 607.

The quantized spectral, or Linear Predictive, parameters are also conveyed locally to an LPC synthesis filter 605 that has a corresponding transfer function $1/A_q(z)$. LPC synthesis filter 605 also receives a combined excitation signal u(n) from a first combiner 610 and produces an estimate of the input signal s(n) based on the quantized spectral parameters $A_q$ and the combined excitation signal u(n). Combined excitation signal u(n) is produced as follows. An adaptive codebook code-vector $c_\tau$ is selected from an adaptive codebook (ACB) 603 based on an index parameter τ and the combined excitation signal from the previous subframe u(n-L). The adaptive codebook code-vector $c_\tau$ is then weighted based on a gain parameter β 630 and the weighted adaptive codebook code-vector is conveyed to first combiner 610. A fixed codebook code-vector $c_k$ is selected from a fixed codebook (FCB) 604 based on an index parameter k. The fixed codebook code-vector $c_k$ is then weighted based on a gain parameter γ 640 and is also conveyed to first combiner 610. First combiner 610 then produces combined excitation signal u(n) by combining the weighted version of adaptive codebook code-vector $c_\tau$ with the weighted version of fixed codebook code-vector $c_k$.

LPC synthesis filter 605 conveys the input signal estimate ŝ(n) to a second combiner 612. The second combiner 612 also receives input signal s(n) and subtracts the estimate of the input signal ŝ(n) from the input signal s(n). The difference between input signal s(n) and the input signal estimate ŝ(n) is applied to a perceptual error weighting filter 606, which filter produces a perceptually weighted error signal e(n) based on the difference between ŝ(n) and s(n) and a weighting function W(z). Perceptually weighted error signal e(n) is then conveyed to squared error minimization/parameter quantization block 607. Squared error minimization/parameter quantization block 607 uses the error signal e(n) to determine an optimal set of codebook-related parameters τ, β, k, and γ that produce the best estimate ŝ(n) of the input signal s(n).

FIG. 7 is a block diagram of a decoder 700 of the prior art that corresponds to the encoder 600. As one of ordinary skilled in the art realizes, the coded bitstream produced by the encoder 600 is used by a demultiplexer 708 in the decoder 700 to decode the optimal set of codebook-related parameters, τ, β730, k, and γ 740. The decoder 700 uses a process that is identical to the synthesis process performed by encoder 600, by using an adaptive codebook 703, a fixed codebook 704, signals u(n) and u(n−L), code-vectors $c_\tau$ and $c_k$, and a LPC synthesis filter 705 to generate output speech. Thus, if the coded bitstream produced by the encoder 600 is received by the decoder 700 without errors, the speech ŝ(n) output by the decoder 700 can be reconstructed as an exact duplicate of the input speech estimate s(n) produced by the encoder 600.

While the CELP encoder 600 is conceptually useful, it is not a practical implementation of an encoder where it is desirable to keep computational complexity as low as possible. As a result, FIG. 8 is a block diagram of an exemplary encoder 800 of the prior art that utilizes an equivalent, and yet more practical, system compared to the encoding system illustrated by encoder 600. To better understand the relationship between the encoder 600 and the encoder 800, it is beneficial to look at the mathematical derivation of encoder 800 from encoder 600. For the convenience of the reader, the variables are given in terms of their z-transforms.

From FIG. 6, it can be seen that the perceptual error weighting filter 606 produces the weighted error signal e(n) based on a difference between the input signal and the estimated input signal, that is:

$$E(z)=W(z)(S(z)-\hat{S}(z)). \tag{1}$$

From this expression, the weighting function W(z) can be distributed and the input signal estimate ŝ(n) can be decomposed into the filtered sum of the weighted codebook code-vectors:

$$E(z) = W(z)S(z) - \frac{W(z)}{A_q(z)}(\beta C_\tau(z) + \gamma C_k(z)). \tag{2}$$

The term W(z)S(z) corresponds to a weighted version of the input signal. By letting the weighted input signal W(z)S(z) be defined as $S_w(z)=W(z)S(z)$ and by further letting the weighted synthesis filter 605 of the encoder 600 now be defined by a transfer function $H(z)=W(z)/A_q(z)$, Equation 2 can rewritten as follows:

$$E(z)=S_w(z)-H(z)(\beta C_\tau(z)+\gamma C_k(z)). \tag{3}$$

By using z-transform notation, filter states need not be explicitly defined. Now proceeding using vector notation, where the vector length L is a length of a current speech input subframe, Equation 3 can be rewritten as follows by using the superposition principle:

$$e=s_w-H(\beta c_\tau+\gamma c_k)-h_{zir}, \tag{4}$$

where:

H is the L×L zero-state weighted synthesis convolution matrix formed from an impulse response of a weighted synthesis filter h(n), such as synthesis filters 815 and 805, and corresponding to a transfer function $H_{zs}(z)$ or H(z), which matrix can be represented as:

$$H=\begin{bmatrix} h(0) & 0 & \cdots & 0 \\ h(1) & h(0) & \cdots & 0 \\ \vdots & \vdots & \ddots & \vdots \\ h(L-1) & h(L-2) & \cdots & h(0) \end{bmatrix}, \tag{5}$$

$h_{zir}$ is a L×1 zero-input response of H(z) that is due to a state from a previous speech input subframe, $s_w$ is the L×1 perceptually weighted input signal, β is the scalar adaptive codebook (ACB) gain, $c_\tau$ is the L×1 ACB code-vector indicated by index τ, γ is the scalar fixed codebook (FCB) gain, and $c_k$ is the L×1 FCB code-vector indicated by index k.

By distributing H, and letting the input target vector $x_w=s_w-h_{zir}$, the following expression can be obtained:

$$e=x_w-\beta Hc_\tau-\gamma Hc_k. \tag{6}$$

Equation 6 represents the perceptually weighted error (or distortion) vector e(n) produced by a third combiner 808 of encoder 800 and coupled by the combiner 808 to a squared error minimization/parameter quantization block 807.

From the expression above, a formula can be derived for minimization of a weighted version of the perceptually weighted error, that is, $\|e\|^2$, by squared error minimization/parameter quantization block 807. A norm of the squared error is given as:

$$\epsilon=\|e\|^2=\|x_w-\beta Hc_\tau-\gamma Hc_k\|^2. \tag{7}$$

Note that $\|e\|^2$ may also be written as $\|e\|^2=\Sigma_{n=0}^{L-1}e^2(n)$ or $\|e\|^2=e^Te$, where $e^T$ is the vector transpose of e, and is presumed to be a column vector.

Due to complexity limitations, practical implementations of speech coding systems typically minimize the squared error in a sequential fashion. That is, the adaptive codebook (ACB) component is optimized first by assuming the fixed codebook (FCB) contribution is zero, and then the FCB component is optimized using the given (previously optimized) ACB component. The ACB/FCB gains, that is, codebook-related parameters β and γ, may or may not be re-optimized, that is, quantized, given the sequentially selected ACB/FCB code-vectors $c_\tau$ and $c_k$.

The theory for performing such an example of a sequential optimization process is as follows. First, the norm of the squared error as provided in Equation 7 is modified by setting γ=0, and then expanded to produce:

$$\epsilon=\|x_w-\beta Hc_\tau\|^2=x_w^Tx_w-2\beta x_w^THc_\tau+\beta^2c_\tau^TH^THc_\tau. \tag{8}$$

Minimization of the squared error is then determined by taking the partial derivative of ϵ with respect to β and setting the quantity to zero:

$$\frac{\partial\varepsilon}{\partial\beta}=x_w^THc_\tau-\beta c_\tau^TH^THc_\tau=0. \tag{9}$$

This yields an optimal ACB gain:

$$\beta=\frac{x_w^THc_\tau}{c_\tau^TH^THc_\tau}. \tag{10}$$

Substituting the optimal ACB gain back into Equation 8 gives:

$$\tau^*=\underset{\tau}{\operatorname{argmin}}\left\{x_w^Tx_w-\frac{(x_w^THc_\tau)^2}{c_\tau^TH^THc_\tau}\right\}, \tag{11}$$

where τ* is an optimal ACB index parameter, that is, an ACB index parameter that minimizes the bracketed expression. Typically, τ is a parameter related to a range of expected values of the pitch lag (or fundamental frequency) of the input signal, and is constrained to a limited set of values that can be represented by a relatively small number of bits. Since $x_w$ is not dependent on τ, Equation 11 can be rewritten as follows:

$$\tau^*=\underset{\tau}{\operatorname{argmax}}\left\{\frac{(x_w^THc_\tau)^2}{c_\tau^TH^THc_\tau}\right\}. \tag{12}$$

Now, by letting $y_\tau$ equal the ACB code-vector $c_\tau$ filtered by weighted synthesis filter 815, that is, $y_\tau=Hc_\tau$, Equation 13 can be simplified to:

$$\tau^*=\underset{\tau}{\operatorname{argmax}}\left\{\frac{(x_w^Ty_\tau)^2}{y_\tau^Ty_\tau}\right\}, \tag{13}$$

and likewise, Equation 10 can be simplified to:

$$\beta=\frac{x_w^Ty_\tau}{y_\tau^Ty_\tau}. \tag{14}$$

Thus Equations 13 and 14 represent the two expressions necessary to determine the optimal ACB index τ and ACB gain β in a sequential manner. These expressions can now be used to determine the optimal FCB index and gain expressions. First, from FIG. 8, it can be seen that a second combiner 806 produces a vector $x_2$, where $x_2=x_w-\beta Hc_\tau$. The vector $x_w$ (or $x_w(n)$) is produced by a first combiner 804 that subtracts a filtered past synthetic excitation signal $h_{zir}(n)$, after filtering past synthetic excitation signal u(n-L) by a weighted synthesis zero input response $H_{zir}(z)$ filter 801, from an output $s_w(n)$ of a perceptual error weighting filter W(z) 802 of input speech signal s(n). The term $\beta Hc_\tau$ is a filtered and weighted version of ACB code-vector $e_\tau$, that is, ACB code-vector $c_\tau$ filtered by zero state weighted synthesis filter $H_{zs}(z)$ 815 to generate y(n) and then weighted based on ACB gain parameter β830. Substituting the expression $x_2=x_w-\beta Hc_\tau$ into Equation 7 yields:

$$\epsilon=\|x_2-\gamma Hc_k\|^2. \tag{15}$$

where $\gamma Hc_k$ is a filtered and weighted version of FCB code-vector $c_k$, that is, FCB code-vector $c_k$ filtered by zero state weighted synthesis filter $H_{zs}(z)$ 805 and then weighted based on FCB gain parameter $\gamma$ 840. Similar to the above derivation of the optimal ACB index parameter $\tau^*$, it is apparent that:

$$k^* = \underset{k}{\operatorname{argmax}}\left\{\frac{(x_2^T Hc_k)^2}{c_k^T H^T Hc_k}\right\}, \tag{16}$$

where k* is an optimal FCB index parameter, that is, an FCB index parameter that maximizes the bracketed expression. By grouping terms that are not dependent on k, that is, by letting $d_2^T = x_2^T H$ and $\Phi = H^T H$, Equation 16 can be simplified to:

$$k^* = \underset{k}{\operatorname{argmax}}\left\{\frac{(d_2^T c_k)^2}{c_k^T \Phi c_k}\right\}, \tag{17}$$

in which the optimal FCB gain $\gamma$ is given as:

$$\gamma = \frac{d_2^T c_k}{c_k^T \Phi c_k}. \tag{18}$$

The encoder 800 provides a method and apparatus for determining the optimal excitation vector-related parameters $\tau$, $\beta$, k, and $\gamma$. Unfortunately, higher bit rate CELP coding typically requires higher computational complexity due to a larger number of codebook entries that require error evaluation in the closed loop processing. Thus, there is an opportunity for generating a candidate code-vector to reduce the computational complexity to code an information signal.

DETAILED DESCRIPTION

As discussed above, higher bit rate CELP coding typically requires higher computational complexity due to a larger number of codebook entries that require error evaluation in the closed loop processing. Embodiments of the present disclosure can solve a problem of searching higher bit rate codebooks by providing for pre-quantizer candidate generation in a Code Excited Linear Prediction (CELP) speech coder. Embodiments can address the problem by generating a plurality of initial FCB candidates through direct quantization of a set of vectors formed using inverse weighting functions and the FCB target signal and then evaluating a weighted error of those initial candidates to produce a better overall code-vector. Embodiments can also apply variable weights to vectors and can sum the weighted vectors as part of preselecting candidate code-vectors. Embodiments can additionally generate a plurality of initial fixed codebook candidates through direct quantization of a set of vectors formed using inverse weighting functions and the fixed codebook target signal, and can then evaluate the weighted error of those initial candidates to produce a better overall code-vector. Other embodiments can also generate a plurality of initial FCB candidates through direct quantization of a set of vectors formed using inverse weighting functions and the FCB target signal, and then evaluating a weighted error of those initial candidates to determine a better initial weighting function for a given pre-quantizer function.

To achieve the above benefits, a method and apparatus can generate a candidate code-vector to code an information signal. The method can include receiving an input signal. The method can include producing a target vector from the input signal. The method can include constructing a plurality of inverse weighting functions based on the target vector. The method can include evaluating an error value associated with each of the plurality of inverse weighting functions to produce a Fixed Codebook (FCB) code-vector. The method can include generating a codeword representative of the FCB code-vector, where the codeword can be used by a decoder to generate an approximation of the input signal.

Figure 1:
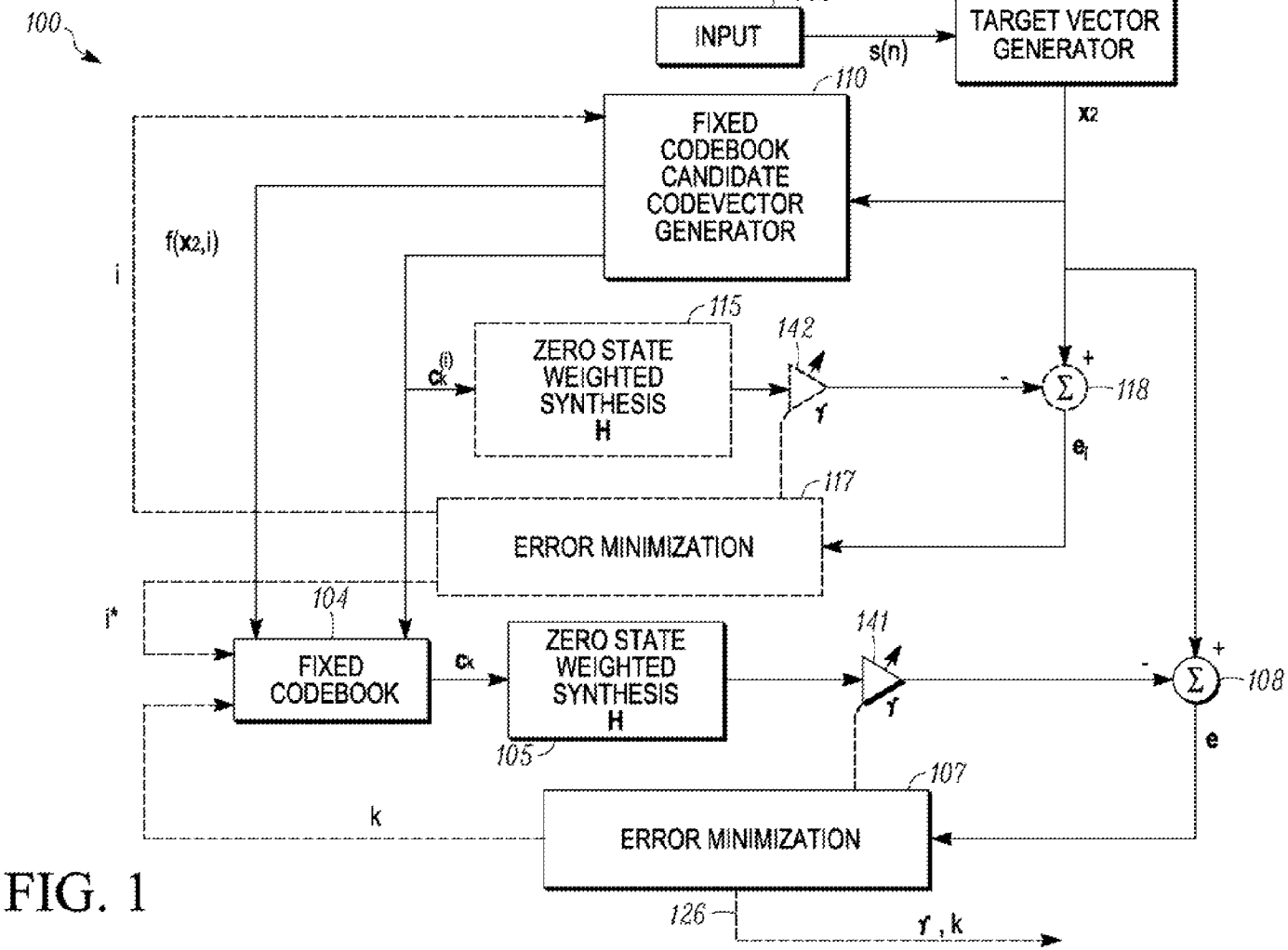
FIG. 1 is an example block diagram of at least a portion of a coder, such as a portion of the coder in FIG. 6, according to one embodiment.

FIG. 1 is an example block diagram of at least a portion of a coder 100, such as a portion of the coder 600, according to one embodiment. The coder 100 can include an input 122, a target vector generator 124, a FCB candidate code-vector generator 110, a FCB 104, a zero state weighted synthesis filter H 105, an error minimization block 107, a first gain parameter $\gamma$ weighting block 141, a combiner 108, and an output 126. The coder 100 can also include a second zero state weighted synthesis filter H 115, a second error minimization block 117, a second gain parameter $\gamma$ weighting block 142, and a second combiner 118.

Figure 8:
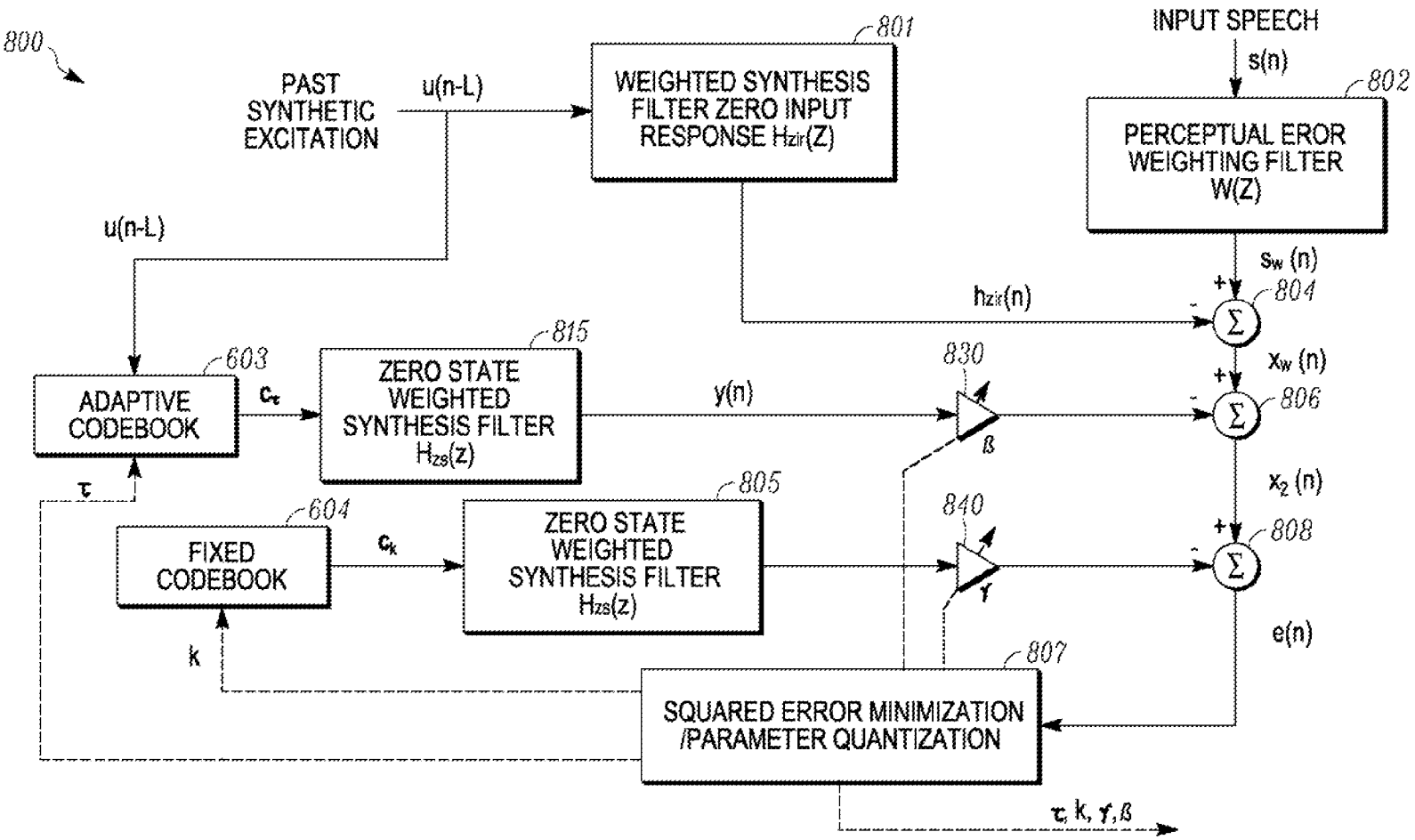
PRIOR ART FIG. 8
FIG. 8 is a block diagram of another CELP encoder of the prior art.

The zero state weighted synthesis filter 105, the error minimization block 107, and the combiner 108, as well as the second zero state weighted synthesis filter H 115, the second error minimization block 117, and the second combiner 118 can operate similarly to the zero state weighted synthesis filter 805, the squared error minimization parameter quantizer 807, and the combiner 808, respectively, as illustrated in FIG. 8. A codebook, such as the FCB 104, can include of a set of pulse amplitude and position combinations. Each pulse amplitude and position combination can define L different positions and can include both zero-amplitude pulses and non-zero-amplitude pulses assigned to respective positions p=1, 2, . . . L of the combination.

In operation, the input 122 can receive and may process an input signal s(n). The input signal s(n) can be a digital or analog input signal. The input can be received wirelessly, through a hard-wired connection, from a storage medium, from a microphone, or otherwise received. For example, the input signal s(n) can be based on an audible signal, such as speech. The target vector generator 124 can receive the input signal s(n) from the input 122 and can produce a target vector $x_2$ from the input signal s(n).

The FCB candidate code-vector generator 110 can receive the target vector $x_2$ and can construct a plurality of candidate code-vectors $c_k^{[i]}$ and an inverse weighting function $f(x_2,i)$, where i can be an index for the candidate code-vectors $c_k^{[i]}$ where $0 \le i < N$, and N is at least 2. The plurality of candidate code-vectors $c_k^{[i]}$ can be based on the target vector $x_2$ and can be based on the inverse weighting function. The inverse weighting function can remove weighting from the target vector $x_2$ in some manner. For example, an inverse weighting function can be based on $$f(x_2, i) = a_i \frac{r}{\|r\|} + b_i \frac{d_2}{\|d_2\|},$$

described below, or can be other inverse weighting functions described below. Additionally, the FCB 104 may also use the inverse weighting function result as a means of further reducing the search complexity, for example, by searching only a subset of the total pulse/position combinations. The error minimization block 117 may also select one of a plurality of candidate code-vectors $c_k^{[i]}$ with lower squared sum value of $e_i$ as $c_k^{i*}$. That is, after the best candidate code-vector $c_k^{i*}$ is found by way of square error minimization, the fixed codebook 104 may use $c_k^{i*}$ as an initial "seed" code-vector which may be iterated upon. The inverse weighting function result $f(x_2, i^*)$ may also be used in this process to help reduce search complexity. Thus, i* can represent the index value of the optimum candidate codevector $c_k^{[i]}$. If the coder 100 does not include the second zero state weighted synthesis filter H 115, the second error minimization block 117, the second gain parameter γ weighting block 142, and the second combiner 118, the remaining blocks can perform the corresponding functions. For example, the error minimization block 107 can provide the index i of the candidate codevectors and the index value i* of the optimum candidate codevector and the zero state weighted synthesis filter 105 can receive the candidate code-vectors $c_k^{[i]}$ (not shown).

According to an example embodiment, the FCB candidate code-vector generator 110 can construct the plurality of candidate code-vectors $c_k^{[i]}$ based on the target vector $x_2$, based on an inverse filtered vector, and based on a backward filtered vector as described below. The plurality of candidate code-vectors $c_k^{[i]}$ can also be based on the target vector $x_2$ and based on a sum of a weighted inverse filtered vector and weighted backward filtered vector as described below.

The error minimization block 117 can evaluate an error vector $e_i$ associated with each of the plurality of candidate code-vectors $c_k^{[i]}$. The error vector can be analyzed to select a single FCB code-vector $c_k^{[i^*]}$, where the FCB code-vector $c_k^{[i^*]}$ can be one of the candidate code-vectors $c_k^{[i]}$. The squared error minimization/parameter quantization block 107 can generate a codeword k representative of the FCB code-vector $c_k^{[i]}$. The codeword k can be used by a decoder to generate an approximation of the input signal s(n). The error minimization block 107 or another element can output the codeword k at the output 126 by transmitting the codeword k and/or storing the codeword k. For example, the error minimization block 117 may generate and output the codeword k.

Each candidate code-vector $c_k^{[i]}$ can be processed as if it were generated by the FCB 104 by filtering it through the zero state weighted synthesis filter 105 for each candidate $c_k^{[i]}$. The FCB candidate code-vector generator 110 can evaluate an error value associated with each iteration of the plurality of candidate code-vectors $c_k^{[i]}$ from the plurality of times to produce a FCB code-vector $c_k$ based on the candidate code-vector $c_k^{[i]}$ with the lowest error value.

The codeword k can also be generated without iterating it through more than one stage. For example, the codeword k can be generated without modification using blocks 104, 105, and 108. For example, when FCB candidate code-vector generator 110 produces a sufficient number of pulses, it may already be a good approximation of the target signal $x_2$ without the need for a second stage. It can converge to the best value when it has sufficient bits. Thus, the $c_k$ coming out of the fixed codebook 104 can be identical to the one of the vectors in the initial fixed codebook candidate code-vectors $c_k^{[i]}$. Furthermore, the FCB 104 may not even exist, such as in high bit rate applications where $c_k^{[i]}$ may be good enough. In either case, the candidate code-vector $c_k^{[i]}$ is equivalent to the final code-vector $c_k$, and the index k may be subsequently transmitted or stored for later use by a decoder.

According to some embodiments, there can be multiple inverse functions $f(x_2,i)$, where $1<=i<=N$ and $N>1$, evaluated for every frame of speech. Multiple $f(x_2,i)$ outputs can be used to determine a codebook output, which can be $c_k^{[i]}$ or $c_k$. Additionally, $c_k^{[i]}$ can be a starting point for determining $c_k$, where $c_k^{[i]}$ can allow for fewer iterations of k and can allow for a better overall result by avoiding local minima.

Figure 2:
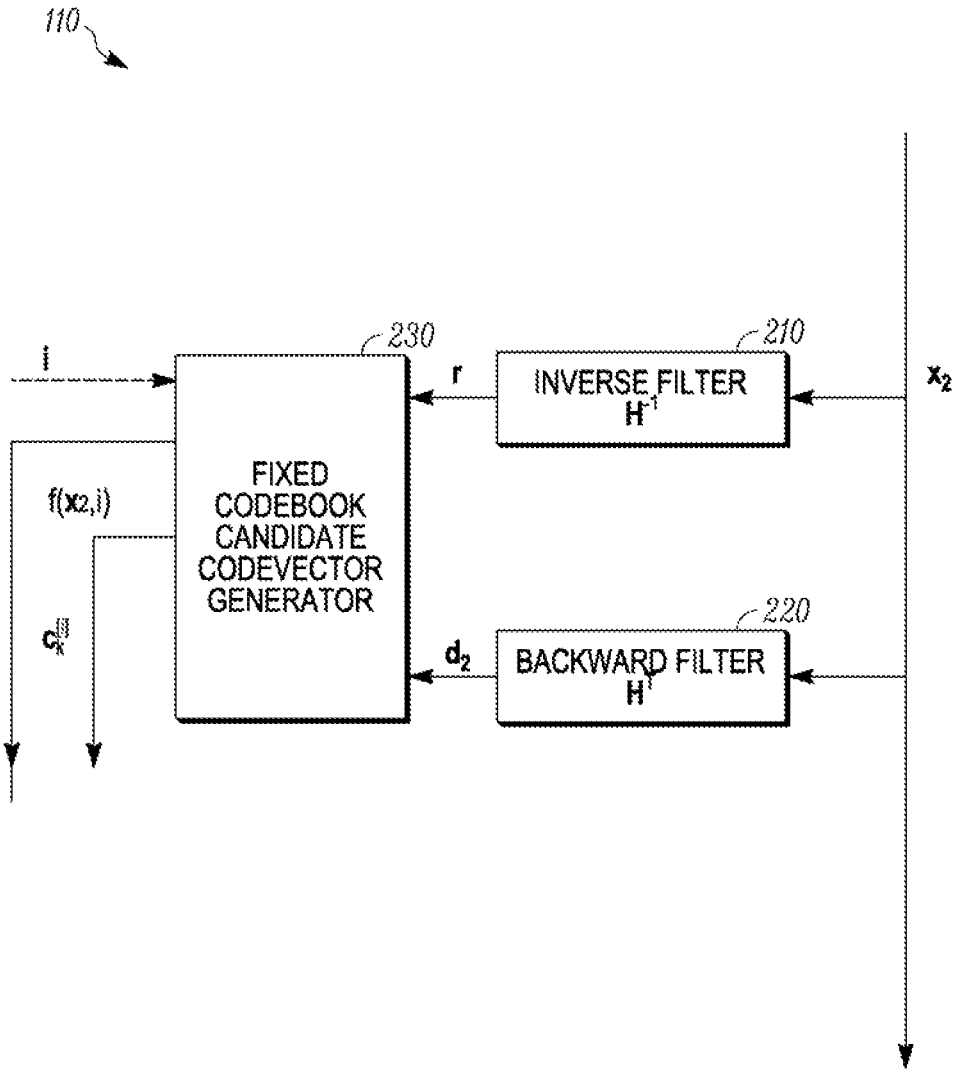
FIG. 2 is an example block diagram of the FCB candidate code-vector generator according to one embodiment.

FIG. 2 is an example block diagram of the FCB candidate code-vector generator 110 according to one embodiment. The FCB candidate code-vector generator 110 can include an inverse filter 210, a backward filter 220, and another processing block for a FCB candidate code-vector generator 230.

The FCB candidate code-vector generator 110 can construct a plurality of candidate code-vectors $c_k^{[i]}$, where i can be an index for the candidate code-vectors $c_k^{[i]}$. The plurality of candidate code-vectors $c_k^{[i]}$ can be based on the target vector $x_2$ and can be based on an inverse weighting function, such as $f(x_2,i)$. The inverse weighting function can be based on an inverse filtered vector and the inverse filter 210 can construct the inverse filtered vector from the target vector $x_2$. For example, the inverse filtered vector can be constructed based on $r=H^{-1}x_2$, where r can be the inverse filtered vector, where $H^{-1}$ can be a zero-state weighted synthesis convolution matrix formed from an impulse response of a weighted synthesis filter, and where $x_2$ can be the target vector. Other variations are described in other embodiments.

The inverse weighting function can be based on a backward filtered vector, and the backward filter 220 can construct the backward filtered vector from the target vector $x_2$. For example, the backward filtered vector can be constructed based on $d_2=H^T x_2$, where $d_2$ can be the backward filtered vector, where $H^T$ can be a transpose of a zero-state weighted synthesis convolution matrix formed from an impulse response of a weighted synthesis filter, and where $x_2$ can be the target vector. Other variations are described in other embodiments.

According to an example embodiment, recalling from the Background that $$\epsilon = \|x_2 - \gamma H c_k\|^2, \quad (15)(19)$$

if the FCB code-vector is given as:

$$c_k = \frac{1}{\gamma} H^{-1} x_2, \quad (20)$$

then the error ϵ can tend to zero and the input signal s(n) and a corresponding coded output signal ŝ(n) can be identical. Since this is not practical for low rate speech coding systems, only a crude approximation of Eq. 20 is typically generated. U.S. Pat. No. 5,754,976 to Adoul, hereby incorporated by reference, discloses one example of the usage of the inverse filtered target signal $r=H^{-1}x_2$ as a method for low bit rate pre-selection of the pulse amplitudes of the code-vector $c_k$.

One of the problems in evaluating the error term $\epsilon$ in Eq. 19 is that, while the error $\epsilon$ is evaluated in the weighted synthesis domain, the FCB code-vector $c_k$ is generated in the residual domain. Thus, a direct PCM-like quantization of the right hand term in Eq. 20 does not generally produce the minimum possible error in Eq. 19, due to the quantization error generation being in the residual domain as opposed to the weighted synthesis domain. More specifically, the expression:

$$c_k = Q_P\left\{\frac{1}{\gamma}H^{-1}x_2\right\}, \tag{21}$$

where $Q_P\{\ \}$ is a P-bit quantization operator, does not generally lead to the global minimum weighted error since the error due to $Q_P\{\ \}$ is a residual domain error. In order to achieve the lowest possible error in the weighted domain, many iterations of $c_k$ may be necessary to minimize the error $\epsilon$ of Eq. 19. Various embodiments of the present disclosure described below can address this problem by reducing the iterations and by reducing the residual domain error.

First, an i-th pre-quantizer candidate $c_k^{[i]}$ can be generated by the FCB candidate code-vector generator 110 using the expression $$c_k^{[i]}=Q_P\{f(x_2,i)\},\ 0\le i<N, \tag{22}$$

where $f(x_2,i)$ can be some function of the target vector, and N can be the number of pre-quantizer candidates. This expression can be a generalized form for generating a plurality of pre-quantizer candidates that can be assessed for error in the weighted domain. An example of such a function is given as:

$$f(x_2,\ i) = a_i\frac{r}{\|r\|} + b_i\frac{d_2}{\|d_2\|}, \tag{23}$$

where $r=H^1x_2$ is the inverse filtered target signal, $d_2=H^Tx_2$ is the backward filtered target as calculated/defined in Eq. 17, and $a_i$ and $b_i$ are a set of respective weighting coefficients for iteration i. Here, $|r|$ can be a norm of the residual domain vector r, such as the inverse filtered target vector r, given by $\|r\|=\sqrt{r^Tr}$, and likewise $\|d_2\|=\sqrt{d_2^Td_2}$. The effect of coefficients $a_i$ and $b_i$, can be to produce a weighted sum of the inverse and backward filtered target vectors, which can then form the set of pre-quantizer candidate vectors.

Embodiments of the present disclosure can allow various coefficient functions to be incorporated into the weighting of the normalized vectors in Eq. 23. For example, the functions:

$$a_i=1-i/(N-1),$$

$$b_i=i/(N-1),\ 0\le i<N, \tag{24}$$

where N is the total number of pre-quantizer candidates, can have a linear distribution of values. As an example, if N=4, the sets of coefficients can be: $a_i \in\{1.0, 0.667, 0.333, 0.0\}$, and $b_i \in\{0.0, 0.333, 0.667, 1.0\}$. Another example may incorporate the results of a training algorithm, such as the Linde-Buzo-Gray (or LBG) algorithm, where many values of a and b can be evaluated offline using a training database, and then choosing $a_i$ and $b_i$ based on the statistical distributions. Such methods for training are well known in the art. Other functions can also be possible. For example, the following function may be found to be beneficial for certain classes of signals:

$$f(x_2,i)=a_ir+b_ir_{lpf}, \tag{25}$$

where $r_{lpf}$ can be a low pass filtered version of r. Alternatively, the LPF characteristic may be altered as a function of i:

$$f(x_2,i)=B_ir, \tag{26}$$

where $B_i$ may be a class of linear phase filtering characteristics intended to shape the residual domain quantization error in a way that more closely resembles that of the error in the weighted domain. Yet another method may involve specifying a family of inverse perceptual weighting functions that may also shape the error in a way that is beneficial in shaping the residual domain error:

$$f(x_2,i)=H_i^{-1}x_2, \tag{27}$$

The weighted signal can then be quantified into a form that can be utilized by the particular FCB coding process. U.S. Pat. No. 5,754,976 to Adoul and U.S. Pat. No. 6,236,960 to Peng, hereby incorporated by reference, disclose coding methods that use unit magnitude pulse codebooks that are algebraic in nature. That is, the codebooks are generated on the fly, as opposed to being stored in memory, searching various pulse position and amplitude combinations, finding a low error pulse combination, and then coding the positions and amplitudes using combinatorial techniques to form a codeword k that is subsequently used by a decoder to regenerate $c_k$ and further generate an approximation of the input signal s(n).

According to one embodiment, the codebook disclosed in U.S. Pat. No. 6,236,960 can be used to quantify the weighted signal into a form that can be utilized by the particular FCB coding process. The i-th pre-quantizer candidate $c_k^{[i]}$ may be obtained from Eq. 22 by iteratively adjusting a gain term $g_Q$ as:

$$c_k^{[i]} = \text{round}(g_Q f(x_2,\ i)):\sum_n |c_k^{[i]}(n)| = M, \tag{28}$$

where the round( ) operator rounds the respective vector elements of $g_Qf(x_2,i)$ to the nearest integer value, where n represents the n-th element of vector $c_k^{[i]}$, and M is the total number of unit magnitude pulses. This expression describes a process of selecting $g_Q$ such that the total number of unit amplitude pulses in $c_k^{[i]}$ equals M.

Many other ways of determining $c_k^{[i]}$ from $f(x_2,i)$ exist. For example, a median search based quantization method may be employed. This can be an iterative process involving finding an optimum pulse configuration satisfying the pulse sum constraint for a given gain and then finding an optimum gain for the optimum pulse configuration. A practical example of such a median search based quantization is given in ITU-T Recommendation G.718 entitled "Frame error robust narrowband and wideband embedded variable bit-rate coding of speech and audio from 8-32 kbit/s", section 6.11.6.2.4, pp. 153, which is hereby incorporated by reference.

The N different pre-quantizer candidates may then be evaluated according to the following expression (which is based on Eq. 17):

$$i^* = \underset{0 \le i < N}{\operatorname{argmax}} \left\{ \frac{(d_2^T c_k^{[i]})^2}{c_k^{[i]T} \Phi c_k^{[i]}} \right\}, \tag{29}$$

where $c_k^{[i]}$ can be substituted for $c_k$, and the best candidate i* out of N candidates can be selected. Alternatively, i* may be determined through brute force computation:

$$i^* = \underset{0 \le i < N}{\operatorname{argmax}} \left\{ \frac{(x_2^T y_2^{[i]})^2}{y_2^{[i]T} y_2^{[i]}} \right\}, \tag{30}$$

where $y_2^{[i]}=Hc_k^{[i]}$ and can be the i-th pre-quantizer candidate filtered though the zero state weighted synthesis filter 105. The latter method may be used for complexity reasons, especially when the number of non-zero positions in the pre-quantizer candidate, $c_k^{[i]}$, is relatively high or when the different pre-quantizer candidates have very different pulse locations. In those cases, the efficient search techniques described in the prior art do not necessarily hold.

After the best pre-quantizer candidate $c_k^{[i^*]}$ is selected, a post-search may be conducted to refine the pulse positions, and/or the signs, so that the overall weighted error is reduced further. The post-search may be one described by Eq. 29. In this case, the numerator and denominator of Eq. 29 may be initialized by letting $c_k=c_k^{[i^*]}$, and then iterating on k to reduce the weighted error. It is not necessary for $c_k^{[i^*]}$ to contain the exact number of pulses as allowed by the FCB. For example, the FCB configuration may allow $c_k$ to contain 20 pulses, but the pre-quantizer stage may use only 10 or 15 pulses. The remaining pulses can be placed by the post search. In another case, the pre-quantizer stage may place more pulses than allowed by the FCB configuration. In this embodiment, the post search may remove pulses in a way that attempts to minimize the weighted error. In yet another embodiment, the number of pulses can be high enough where a post search is not needed since the pre-quantizer candidates can provide adequate quality for a particular application. In one embodiment, however, the number of pulses in the pre-quantizer vector can be generally equal to the number of pulses allowed by a particular FCB configuration. In this case, the post search may involve removing a unit magnitude pulse from one position and placing the pulse at a different location that results in a lower weighted error. This process may be repeated until the codebook converges or until a predetermined maximum number of iterations is reached.

To further expand on the above embodiments where the candidate code-vectors $c_k^{[i]}$ and the eventual FCB output vector $c_k$ may or may not contain the same number of unit magnitude pulses, another embodiment exists where the candidate codebook for generating $c_k^{[i]}$ may be different than the codebook for generating $c_k$. That is, the best candidate $c_k^{[i^*]}$ may generally be used to reduce complexity or improve overall performance of the resulting code-vector $c_k$, by using $c_k^{[i^*]}$ as a means for determining the best inverse function $f(x_2,i^*)$, and then proceeding to use $f(x_2,i^*)$ as a means for searching a second codebook $c'_k$. Such an example may include using a Factorial Pulse Coded (FPC) codebook for generating $c_k^{[i^*]}$, and then using a traditional ACELP codebook to generate $c'_k$, wherein the inverse function $f(x_2,i^*)$ is used in the secondary codebook search $c'_k$, and the candidate code-vectors $c_k^{[i]}$ are discarded. In this way, for example, the pre-selection of pulse signs for the secondary codebook $c'_k$ may be based on a plurality of inverse functions $f(x_2,i)$, and not directly on the candidate code-vectors $c_k^{[i]}$. This embodiment may allow performance improvement to existing codecs that use a specific codebook design, while maintaining interoperability and backward compatibility.

In another embodiment, a very large value of N may be used. For example, if N=100, then the weighting coefficients $[a_i, b_i]$ can span a very high resolution set, and can result in a solution that will yield optimal results.

According to U.S. Pat. No. 7,054,807 to Mittal, which is hereby incorporated by reference, the ACB/FCB parameters may be jointly optimized. The joint optimization can also be used for evaluation of N pre-quantizer candidates. Now Eq. 29 can become:

$$i^* = \underset{0 \le i < N}{\operatorname{argmax}} \left\{ \frac{(d_2^T c_k^{[i]})^2}{c_k^{[i]T} \Phi' c_k^{[i]}} \right\}, \tag{31}$$

where $\Phi'=\Phi-yy^T$ and where y can be a scaled backward filtered ACB excitation. Now i* may be determined through brute force computation:

$$i^* = \underset{0 \le i < N}{\operatorname{argmax}} \left\{ \frac{(x_2^T y_2^{[i]})^2}{y_2^{[i]T} y_2^{[i]} - (y^T c_k^{[i]})^2} \right\}, \tag{32}$$

where $y_2^{[i]}=Hc_k^{[i]}$ can be the i-th pre-quantizer candidate filtered though the zero state weighted synthesis filter 105 and $y^T c_k^{[i]}$ can be a correlation between the i-th pre-quantizer candidate and the scaled backward filtered ACB excitation.

Figure 3:
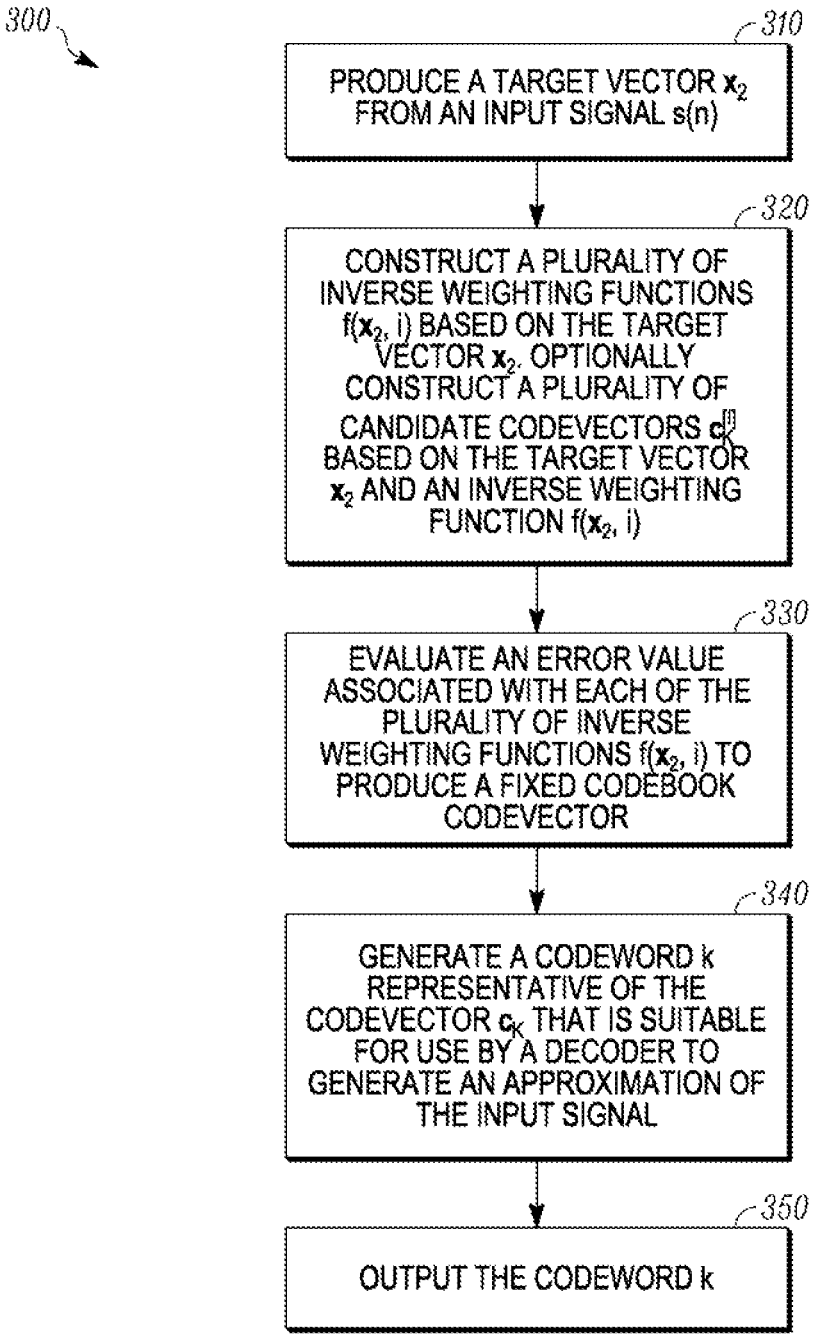
FIG. 3 is an example illustration of a flowchart outlining the operation of a coder according to one embodiment.

FIG. 3 is an example illustration of a flowchart 300 outlining the operation of the coder 100 according to one embodiment. The flowchart 300 illustrates a method that can include the embodiments disclosed above.

At 310, a target vector $x_2$ can be generated from a received input signal s(n). The input signal s(n) can be based on an audible speech input signal. At 320, a plurality of inverse weighting functions $f(x_2,i)$ can be constructed based on the target vector $x_2$. Optionally, a plurality of candidate code-vectors $c_k^{[i]}$ can also be constructed based on the target vector $x_2$ and based on an inverse weighting function $f(x_2,i)$. The plurality of inverse weighting functions $f(x_2,i)$ (and/or plurality of candidate code-vectors $c_k^{[i]}$) can be constructed based on an inverse filtered vector and based on a backward filtered vector along with the target vector $x_2$. The plurality of inverse weighting functions $f(x_2,i)$ (and/or plurality of candidate code-vectors $c_k^{[i]}$) can also be constructed based on a sum of a weighted inverse filtered vector and a weighted backward filtered vector along with the target vector $x_2$.

At 330, an error value $\epsilon$ associated with each code-vector of the plurality of inverse weighting functions $f(x_2,i)$ (and/or plurality of candidate code-vectors $c_k^{[i]}$) can be evaluated to produce a fixed codebook code-vector $c_k$. For example, errors $\epsilon[i]$ of $c_k^{[i]}$ can be evaluated to produce $c_k^{[i^*]}$, then $c_k^{[i^*]}$ can be used as a basis for further searching on $c_k$. The value k can be the ultimate codebook index that is output.

At 340, a codeword k representative of the fixed codebook code-vector $c_k$ can be generated, where the codeword can be used by a decoder to generate an approximation of the input signal s(n). At 350, the codeword k can be output. For example, the codeword k can be a fixed codebook index parameter codeword k that can be output by transmitting the fixed codebook index parameter k and/or storing the fixed codebook index parameter k.

Figure 4:
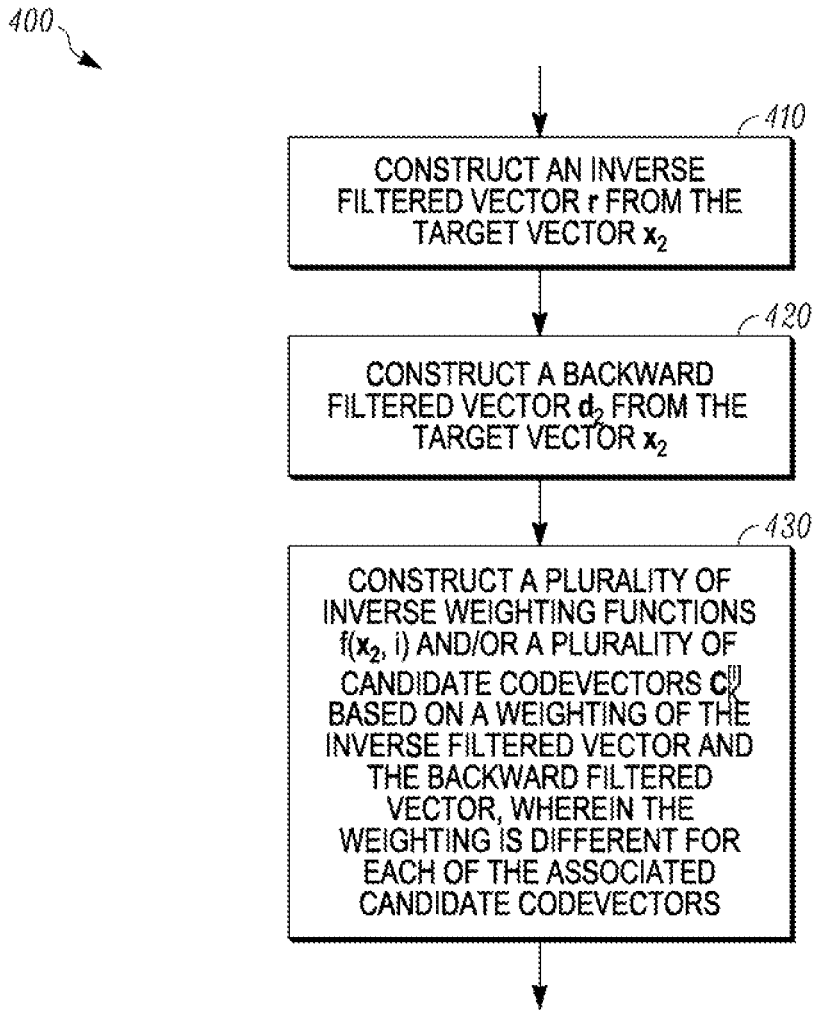
FIG. 4 is an example illustration of a flowchart outlining candidate code-vector construction operation of a coder according to one embodiment.

FIG. 4 is an example illustration of a flowchart 400 outlining the operation of block 320 of FIG. 3 according to one embodiment. At 410, an inverse filtered vector r can be constructed from the target vector $x_2$. The inverse weighting function $f(x_2, i)$ of block 320 can be based on the inverse filtered vector r constructed from the target vector $x_2$. The inverse filtered vector r can be constructed based on $r=H^{-1}x_2$, where r can be the inverse filtered vector, where $H^{-1}$ can be a zero-state weighted synthesis convolution matrix formed from an impulse response of a weighted synthesis filter, and where $x_2$ can be the target vector. Other variations are described in other embodiments above.

At 420, a backward filtered vector $d_2$ can be constructed from the target vector $x_2$. The inverse weighting function $f(x_2, i)$ of block 320 can be based on the backward filtered vector $d_2$ constructed from the target vector $x_2$. The backward filtered vector $d_2$ can be constructed based on $d_2=H^T x_2$, where $d_2$ can be the backward filtered vector, where $H^T$ can be a transpose of a zero-state weighted synthesis convolution matrix formed from an impulse response of a weighted synthesis filter, and where $x_2$ can be the target vector. Other variations are described in other embodiments above.

At 430, a plurality of inverse weighting functions $f(x_2,i)$ (and/or plurality of candidate code-vectors $c_k^{[i]}$) can be constructed based on a weighting of the inverse filtered vector r and a weighting of the backward filtered vector $d_2$, where the weighting can be different for each of the associated candidate code-vectors $c_k^{[i]}$. For example, the weighting can be based on $$f(x_2, i) = a_i \frac{r}{\|r\|} + b_i \frac{d_2}{\|d_2\|}$$

or other weighting described above.

Figure 5:
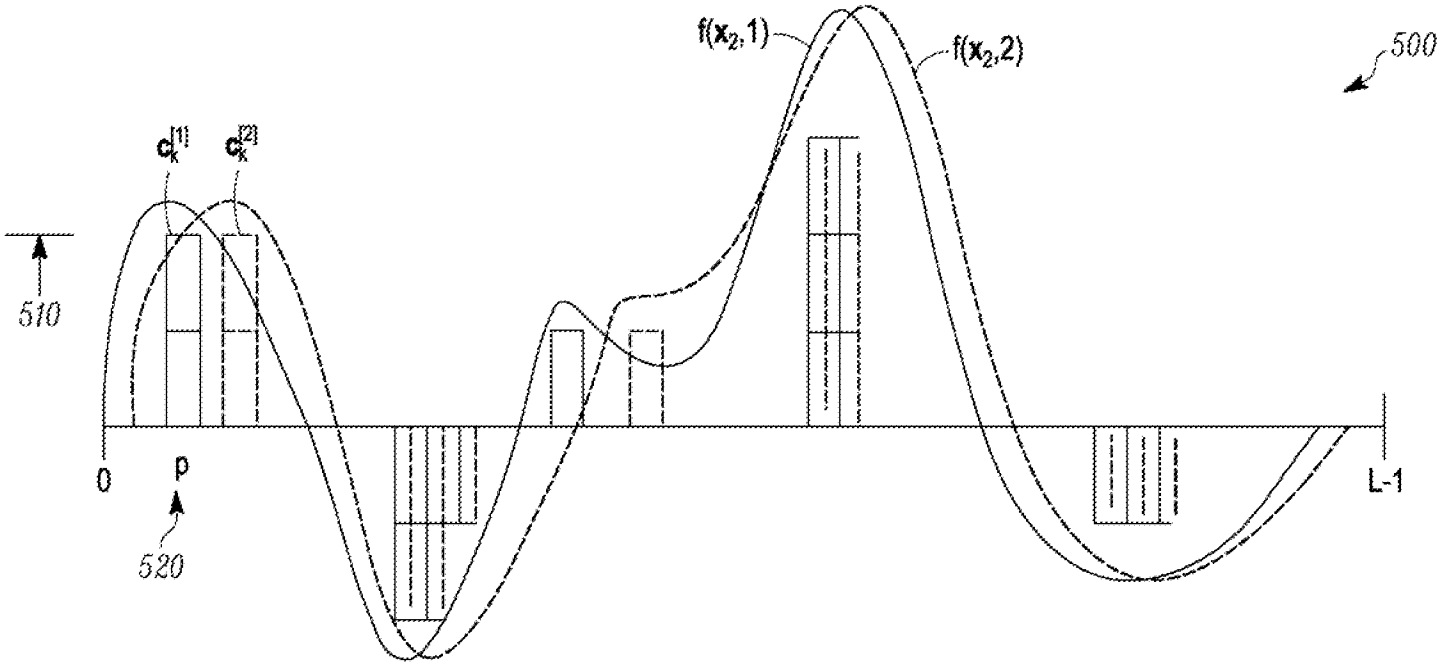
FIG. 5 is an example illustration of two conceptual candidate code-vectors $c_k^{[i]}$ according to one embodiment.
Figure 6:
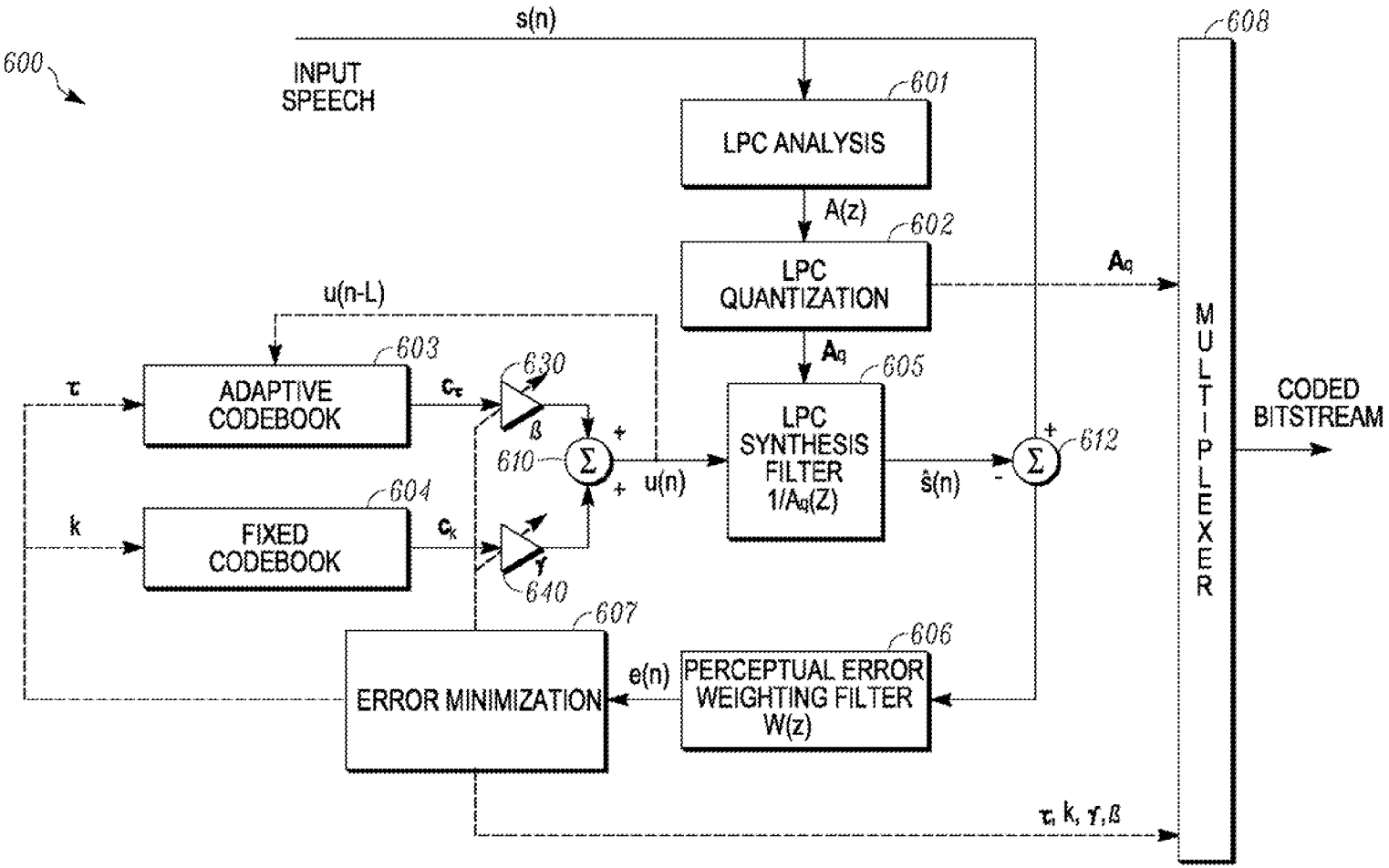
PRIOR ART FIG. 6
FIG. 6 is a block diagram of a Code Excited Linear Prediction (CELP) encoder of the prior art.
Figure 7:
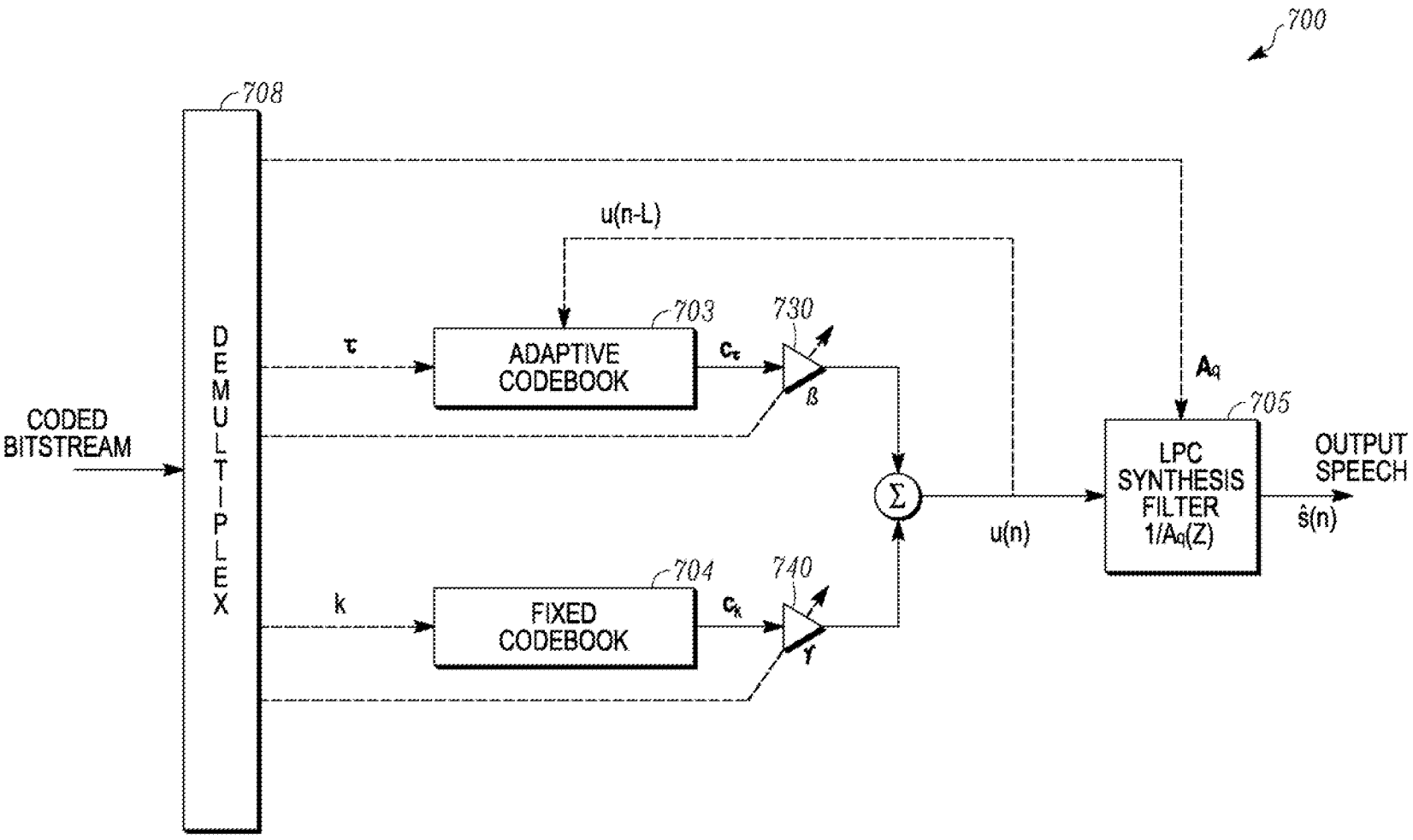
PRIOR ART FIG. 7
FIG. 7 is a block diagram of a CELP decoder of the prior art.

FIG. 5 is an example illustration 500 of two conceptual candidate code-vectors $c_k^{[i]}$ for i=1 and i=2 according to one embodiment. The candidate code-vectors $c_k^{[i]}$ and $c_k^{[2]}$ can correspond to factorial pulse coded vectors for different functions $f(x_2, 1)$ and $f(x_2, 2)$ of a target vector. As discussed above, one of the candidate code-vectors, $c_k^{[i]}$, can be used as a basis for choosing codeword $c_k$ that generates a fixed codebook index parameter k. The fixed codebook index parameter k can identify, at least in part, a set of pulse amplitude and position combinations, such as including a pulse amplitude 510 and a position 520, in a codebook. Each pulse amplitude and position combination can define L different positions and can include both zero-amplitude pulses and non-zero-amplitude pulses assigned to respective positions p=1, 2, . . . L of the combination. The set of pulse amplitude and position combinations can be used for functions $f(x_2, 1)$ and $f(x_2, 2)$ for a chosen candidate code-vector $c_k^{[i*]}$, such as, for example, code-vector $c_k^{[1]}$. The illustration 500 is only intended as a conceptual example and does not correspond to any actual number of pulses, positions of pulses, code-vectors, or signals.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the disclosed embodiments. For example, one of ordinary skill in the art of the disclosed embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

The invention claimed is:

1. A method comprising:

receiving an input signal;

producing a target vector from the input signal;

constructing a plurality of candidate code-vectors based on the target vector and based on at least one inverse weighting function;

evaluating an error value associated with each code-vector of the plurality of candidate code-vectors to produce a fixed codebook code-vector; and generating a codeword representative of the fixed codebook code-vector, where the codeword is for use by a decoder to generate an approximation of the input signal.

2. The method according to claim 1, wherein the method further comprises:

outputting the codeword by one of: transmitting the codeword and storing the codeword.

3. The method according to claim 1, wherein the at least one inverse weighting function is based on an inverse filtered vector constructed from the target vector.

4. The method according to claim 3, wherein the inverse filtered vector is constructed based on $r=H^{-1}x_2$, wherein r comprises the inverse filtered vector, wherein $H^{-1}$ comprises a zero-state weighted synthesis convolution matrix formed from an impulse response of a weighted synthesis filter, and wherein $x_2$ comprises the target vector.

5. The method according to claim 1, wherein the at least one inverse weighting function is based on a backward filtered vector constructed from the target vector.

6. The method according to claim 5, wherein the backward filtered vector is constructed based on $d_2=H^T x_2$, wherein $d_2$ comprises the backward filtered vector, wherein $H^T$ comprises a transpose of a zero-state weighted synthesis convolution matrix formed from an impulse response of a weighted synthesis filter, and wherein $x_2$ comprises the target vector.

7. The method according to claim 1, wherein the constructing comprises:

constructing the plurality of inverse weighting functions based on the target vector, based on an inverse filtered vector, and based on a backward filtered vector.

8. The method according to claim 1, wherein the constructing comprises:

constructing the plurality of inverse weighting functions based on the target vector and based on a sum of a weighted inverse filtered vector and a weighted backward filtered vector.

9. The method according to claim 1, wherein the plurality of candidate code-vectors are based on one of: an inverse filtered vector constructed from the target vector and a backward filtered vector constructed from the target vector.

10. The method according to claim 9, further comprising:

processing each of the plurality of candidate code-vectors using a fixed codebook and through a zero state weighted synthesis filter a plurality of times, wherein the evaluating comprises:

evaluating at least one error value associated with each iteration of the plurality of candidate code-vectors from the plurality of times to produce the fixed codebook code-vector based on the candidate code-vector with a lowest error value.

11. An apparatus comprising:

an input configured to receive an input signal;

a target vector generator configured to produce a target vector from the input signal;

a fixed codebook candidate code-vector generator configured to construct a plurality of candidate code-vectors based on the target vector and based on at least one inverse weighting function;

an error minimization unit configured to evaluate an error value associated with each code-vector of the plurality of candidate code-vectors to produce a fixed codebook code-vector; and an output configured to output a codeword based on the fixed codebook code-vector.

12. The apparatus according to claim 11, further comprising:

wherein the output is configured to output the codeword by one of transmitting the codeword and storing the codeword.

13. The apparatus according to claim 11, wherein the fixed codebook candidate code-vector generator comprises:

an inverse filter for constructing an inverse filtered vector from the target vector, where the at least one inverse weighting function is based on the inverse filtered vector.

14. The apparatus according to claim 13, wherein the inverse filtered vector is constructed based on $r=H^{-1}x_2$, wherein r comprises the inverse filtered vector, wherein $H^{-1}$ comprises a zero-state weighted synthesis convolution matrix formed from an impulse response of a weighted synthesis filter, and wherein $x_2$ comprises the target vector.

15. The apparatus according to claim 11, wherein the fixed codebook candidate code-vector generator comprises:

a backward filter for constructing a backward filtered vector from the target vector, where the at least one inverse weighting function is based on the backward filtered vector.

16. The apparatus according to claim 15, wherein the backward filtered vector is constructed based on $d_2=H^T x_2$, wherein $d_2$ comprises the backward filtered vector, wherein $H^T$ comprises a transpose of a zero-state weighted synthesis convolution matrix formed from an impulse response of a weighted synthesis filter, and wherein $x_2$ comprises the target vector.

17. The apparatus according to claim 11, wherein an inverse weighting function includes an inverse filtered vector weighted by a weighting coefficient.

18. The apparatus according to claim 11, where an inverse weighting function includes a backward filtered vector weighted by a weighting coefficient.

19. The apparatus according to claim 11, wherein the plurality of candidate code-vectors are based on one of: an inverse filtered vector constructed from the target vector by an inverse filter and a backward filtered vector constructed from the target vector by a backward filter.

20. The apparatus according to claim 19, further comprising:

a combiner configured to generate the error value based on each of the plurality of candidate code-vectors constructed from the fixed codebook candidate code-vector generator.

21. The apparatus according to claim 11, further comprising a codeword generator configured to generate the codeword based on the fixed codebook code-vector, where the codeword is for use by a decoder to generate an approximation of the input signal.

22. A method comprising:

receiving an input signal based on audible speech;

producing a target vector from the input signal;

constructing a plurality of candidate code-vectors based on the target vector and based on a plurality of inverse weighting functions;

evaluating an error value associated with each of the plurality of candidate code-vectors to produce a fixed codebook code-vector;

generating a codeword representative of the fixed codebook code-vector, where the codeword is used to generate a fixed codebook index parameter that identifies, at least in part, a set of pulse amplitude and position combinations in a codebook used to generate an approximation of the input signal; and outputting the codeword by one of: transmitting the codeword or storing the codeword.

23. The method according to claim 22, wherein the constructing comprises:

constructing the plurality of candidate code-vectors based on the target vector, based on a weighted inverse filtered vector, and based on a weighted backward filtered vector.

* * * * *